US010598468B2

(12) United States Patent
Gaska et al.

(10) Patent No.: US 10,598,468 B2
(45) **Date of Patent: *Mar. 24, 2020**

(54) SIMULATION OF MISSILE SIGNATURES

(71) Applicant: Sensor Electronic Technology, Inc., Columbia, SC (US)

(72) Inventors: Remigijus Gaska, Columbia, SC (US); Alexander Dobrinsky, Loudonville, NY (US); Maxim S. Shatalov, Columbia, SC (US); Michael Shur, Latham, NY (US)

(73) Assignee: Sensor Electronic Technology, Inc., Columbia, SC (US)

( * ) Notice: Subject to any disclaimer, the term of this patent is extended or adjusted under 35 U.S.C. 154(b) by 975 days.

This patent is subject to a terminal disclaimer.

(21) Appl. No.: 15/049,681

(22) Filed: Feb. 22, 2016

(65) Prior Publication Data

US 2016/0169636 A1 Jun. 16, 2016

Related U.S. Application Data

(63) Continuation of application No. 13/625,363, filed on Sep. 24, 2012, now Pat. No. 9,267,770.

(60) Provisional application No. 61/538,125, filed on Sep. 22, 2011.

(51) Int. Cl.
*G06G 7/48* (2006.01)
*F41J 2/02* (2006.01)
(Continued)

(52) U.S. Cl.
CPC ..... *F41J 2/02* (2013.01); *F41G 7/002* (2013.01); *F41J 2/00* (2013.01); *F41J 9/00* (2013.01); *F41J 9/08* (2013.01); *F41H 11/02* (2013.01)

(58) Field of Classification Search
None
See application file for complete search history.

(56) References Cited

U.S. PATENT DOCUMENTS 4,935,881 A 6/1990 Lowenson et al.
5,012,250 A 4/1991 Foley
(Continued)

FOREIGN PATENT DOCUMENTS

WO WO200406215 A1 * 7/2004

OTHER PUBLICATIONS

Cai, Guobiao, Dingqiang Zhu, and Xiaoying Zhang. "Numerical simulation of the infrared radiative signatures of liquid and solid rocket plumes." Aerospace science and technology 11.6 (2007): 473-480.*

(Continued)

*Primary Examiner* — Rehana Perveen
*Assistant Examiner* — Nithya J. Moll
(74) *Attorney, Agent, or Firm* — LaBatt, LLC

(57) ABSTRACT

An emitting structure for simulating an irradiance signature of a missile is provided. The emitting structure includes one or more radiation sources, each of which includes at least one ultraviolet radiation source and at least one infrared radiation source. The emitting structure also includes a spherical shell and a mechanism for positioning the radiation source(s) along a three dimensional boundary of the spherical shell. The emitting structure can locate and operate one of the radiation sources to simulate the irradiance signature of the missile.

20 Claims, 9 Drawing Sheets

(51) Int. Cl.

| | |
|---|---|
| ***F41J 2/00*** | (2006.01) |
| ***F41J 9/08*** | (2006.01) |
| ***F41G 7/00*** | (2006.01) |
| ***F41J 9/00*** | (2006.01) |
| *F41H 11/02* | (2006.01) |

(56) References Cited

U.S. PATENT DOCUMENTS

| | | | |
|---|---|---|---|
| 5,224,860 | A | 7/1993 | Waldman et al. |
| 5,336,894 | A | 8/1994 | Ellers |
| 5,693,951 | A | 12/1997 | Strong, III |
| 7,528,396 | B1 | 5/2009 | Vavroch |
| 7,906,766 | B2 | 3/2011 | Cox |
| 7,916,065 | B1 | 3/2011 | Mintz et al. |
| 9,267,770 | B2 | 2/2016 | Gaska et al. |
| 2008/0142734 | A1 | 6/2008 | Forsyth et al. |
| 2008/0169423 | A1 | 7/2008 | Betschart et al. |
| 2009/0028193 | A1 | 1/2009 | Islam |
| 2009/0309037 | A1 | 12/2009 | Cox |
| 2009/0324015 | A1 | 12/2009 | Way et al. |

OTHER PUBLICATIONS

Songjiang, Feng, et al. "Numerical simulation of flow field and radiation of an aluminized solid-propellant rocket multiphase exhaust plume." 39th AIAA Thermophysics Conference. 2007.*

Forney, B. et al., "A Spectral Analysis of Ultraviolet (UV) Clutter Sources to Improve Probability of Detection in Helicopter UV Missile Warning Systems," Master's thesis Abstract, 2008, 1 pages, Naval Postgraduate School, Monterey, CA.

Giza, R. et al., "Ultraviolet scene simulation for missile approach warning system testing," 1997, 10 pages, Amherst Systems Incorporated, Buffalo, NY.

Kilpin, D., "Ultraviolet Emission from Rocket Motor Plumes," DSTO Technical Report, DSTO-TR-0002, 1994, 22 pages, DSTO Aeronautical and Maritime Research Laboratory, Melbourne, Victoria, AU.

Meyer, D. et al., "Improvements to real-time ultraviolet scene simulation for sensor testing," Apr. 1998, 11 pages, SPIE vol. 3368, Part of the SPIE Conference on Technologies for Synthetic Environments: Hardware-in-the-Loop Testing III, Orlando, FL.

Neele, F. et al., "Electro-optical missile plume detection," 2003, 11 pages, SPIE vol. 5075, TNO Physics and Electronics Laboratory, The Hague, The Netherlands.

Sutton, G. et al., "Rocket Propulsion Elements," Seventh Edition, 2001, 764 pages, John Wiley & Sons, Inc., New York, NY.

Sutton, G. et al., "Rocket Propulsion Elements," Eighth Edition Updated Description, 2010, Accessed Oct. 2015, 2 pages, John Wiley & Sons, Inc., New York, NY.

Vaghjiani, G., "Investigations of Chemiluminescence in the CH2 + O Gas Phase Reaction," Jul. 2001, 13 pages, ERC, Inc., Air Force Research Laboratory, Edwards AFB, CA.

Moll, N., U.S. Appl. No. 13/625,363, Office Action 1, dated Jul. 9, 2015, 27 pages.

Moll, N., U.S. Appl. No. 13/625,363, Notice of Allowance, dated Oct. 20, 2015, 27 pages.

* cited by examiner

SIMULATION OF MISSILE SIGNATURES

REFERENCE TO RELATED APPLICATIONS

The current application is a continuation of U.S. patent application Ser. No. 13/625,363, which was filed on 24 Sep. 2012, and which claims the benefit of U.S. Provisional Application No. 61/538,125, which was filed on 22 Sep. 2011, each of which is hereby incorporated by reference.

TECHNICAL FIELD

The disclosure relates generally to missile simulation, and more particularly, to simulating an irradiance signature of a missile plume using light emitting diodes.

BACKGROUND ART

A rocket exhaust plume consists of heated gas moving at a high speed and at a high temperature. This gas formation is inhomogeneous in structure, has a non-uniform velocity, and a non-uniform composition. Frequently, a plume contains supersonic shock waves with high gradients of pressure and temperature across the wave region. The plume characteristics, e.g., its size and shape, light emission intensity, and spectral signature, depend not only on the rocket aerodynamic characteristics and the rocket propulsion system, but also on the flight velocity and altitude of the rocket. For example, FIG. 1 shows a representation of the plume characteristics' dependence on a velocity of the rocket as shown in the prior art, and FIG. 2 shows a schematic of the plume diameter as a function of altitude as shown in the prior art.

Detectability of a rocket plume at a particular wavelength is dependent on an intensity of the emission at the wavelength, atmospheric transmittance, and the strength of the background signal. Generally, a plume can be considered as a black body radiating source with a spectral distribution characterized by the plume's temperature. The core of the plume of a supersonic tactical missile has temperatures of approximately 1500 Kelvin. However, unoxidized fuel materials typically mix with ambient air downstream of the plume core and produce a higher temperature afterburning mixing region with temperatures as high as 3000 Kelvin. At these temperatures, blackbody spectra have a non-negligible ultraviolet radiative component.

In addition to black body radiation, spectral lines due to chemical combustion of propellants can superimpose on the infrared spectra. The molecules responsible for most of the gas thermal emissions in missile exhaust plumes are water vapor ($H_2O$), carbon dioxide ($CO_2$), as well as formation of electronically excited hydroxyl (OH) and carbon monoxide (CO) in the chemiluminescence process:

$$2CH+O \rightarrow CO+OH^* \rightarrow CO+OH+h\nu,$$

where OH* indicates the OH is in an excited state.

FIG. 3 shows a representative OH emission spectrum as shown in the prior art. In particular, the ultraviolet OH chemiluminescence observed during a $C_2H_2O$+O atom reaction is shown. Additionally, the table below summarizes spectra from various chemical elements.

| Combustion Product | Emission Mechanism | Significant Spectral Band (μm) |
|---|---|---|
| $CO_2$ | Gas Thermal Emission | Mid IR (3-5) |
| $H_2O$ | Gas Thermal Emission | Near IR (0.75-3) |

-continued

| Combustion Product | Emission Mechanism | Significant Spectral Band (μm) |
|---|---|---|
| CO | Chemiluminescence | Mid UV (0.2-0.3) |
| OH | Chemiluminescence | Mid UV (0.28-0.29) |
| CO | Gas Thermal Emission | Mid IR (4.6-5) |
| C (soot) | Black Body Emission | Mid UV (depending on temperature), IR |
| Light Metal Oxides | Gas Thermal Emission/Graybody | Mid UV |
| Na & Compounds | Gas Thermal Emission | Visible (0.59, 0.68) |
| K & Compounds | Gas Thermal Emission | Near IR (0.79) |

Generated plume light signatures are attenuated by ozone composition of the atmosphere, by humidity of the air, and by molecular oxygen. Additionally, sun background radiation can introduce significant noise, which for certain light wavelengths, can be comparable in amplitude with the plume's light signal. For ultraviolet radiation, there is a narrow window of radiation wavelengths between 270 to 290 nanometers that may not be attenuated by the atmosphere and/or shielded by sun radiation. For clear air, with a low ozone content, and during night time, a slightly wider range of radiation wavelengths may be available.

SUMMARY OF THE INVENTION

Aspects of the invention provide an emitting structure for simulating an irradiance signature of a missile. The emitting structure includes one or more radiation sources, each of which includes at least one ultraviolet radiation source and at least one infrared radiation source. The emitting structure also includes a spherical shell and a mechanism for positioning the radiation source(s) along a three dimensional boundary of the spherical shell. The emitting structure can locate and operate one of the radiation sources to simulate the irradiance signature of the missile.

A first aspect of the invention provides a system comprising: an emitting structure including: a first radiation source including at least one ultraviolet radiation source and at least one infrared radiation source; a spherical shell; and means for positioning the first radiation source along a three dimensional boundary of the spherical shell; and a computer system for simulating an irradiance signature of a missile using the first radiation source and the means for positioning, wherein the simulating includes, for each of a plurality of simulation times: determining a relative location of the simulated missile with respect to a target location; determining a plume irradiance appearance at the target location based on the relative location, a missile type for the missile, and a set of missile operating conditions for the missile; locating the first radiation source to a location on the spherical shell corresponding to the relative location; and generating a radiation pattern simulating the plume irradiance appearance using the first radiation source.

A second aspect of the invention provides a system comprising: a plurality of emitting structures, each emitting structure including: a first radiation source including at least one ultraviolet radiation source and at least one infrared radiation source; a spherical shell; and means for positioning the first radiation source along a three dimensional boundary of the spherical shell; a plurality of detectors, each detector located at a center of the spherical shell of one of the plurality of emitting structures; and a computer system for simulating, for each of the plurality of detectors, an irradiance signature of a missile at the detector using the first radiation source and the means for positioning of the corresponding emitting structure, wherein the simulating includes, for each of the plurality of detectors and a plurality of simulation times: determining a relative location of the simulated missile with respect to a simulated position of the detector; determining a plume irradiance appearance at the detector based on the relative location, a missile type for the missile, and a set of missile operating conditions for the missile; locating the first radiation source to a location on the spherical shell corresponding to the relative location; and generating a radiation pattern simulating the plume irradiance appearance using the first radiation source.

A third aspect of the invention provides a system comprising: an emitting structure including: a plurality of radiation sources, each radiation source including at least one ultraviolet radiation source and at least one infrared radiation source having a unique pattern; a spherical shell; and means for positioning the plurality of radiation sources along a three dimensional boundary of the spherical shell; and a computer system for simulating an irradiance signature of a missile using one of the plurality of radiation sources and the means for positioning, wherein the simulating includes: selecting one of the plurality of radiation sources based on the irradiance signature and the unique pattern for each of the plurality of radiation sources; and for each of a plurality of simulation times: determining a relative location of the simulated missile with respect to a target location; determining a plume irradiance appearance at the target location based on the relative location, a missile type for the missile, and a set of missile operating conditions for the missile; locating the selected radiation source to a location on the spherical shell corresponding to the relative location; and generating a radiation pattern simulating the plume irradiance appearance using the selected radiation source.

Other aspects of the invention provide methods, systems, program products, and methods of using and generating each, which include and/or implement some or all of the actions described herein. The illustrative aspects of the invention are designed to solve one or more of the problems herein described and/or one or more other problems not discussed.

BRIEF DESCRIPTION OF THE DRAWINGS

These and other features of the disclosure will be more readily understood from the following detailed description of the various aspects of the invention taken in conjunction with the accompanying drawings that depict various aspects of the invention.

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

In general, aspects of the invention are directed to simulating an irradiance signature of a missile plume. The simulation can be performed using one or more emitting structures, each of which can be configured to emit radiation corresponding to any of a plurality of possible plume irradiance signatures corresponding to a missile. The radiation emitted by an emitting structure can include ultraviolet, infrared, and/or visible radiation. Various aspects of the emitted radiation can be adjusted to account for different possible plumes being simulated for the missile. The emitting structures can be utilized, for example, as part of an evaluation of a missile warning system.

As indicated above, aspects of the invention provide an emitting structure for simulating an irradiance signature of a missile. The emitting structure includes one or more radiation sources, each of which includes at least one ultraviolet radiation source and at least one infrared radiation source. The emitting structure also includes a spherical shell and a mechanism for positioning the radiation source(s) along a three dimensional boundary of the spherical shell. The emitting structure can locate and operate one of the radiation sources to simulate the irradiance signature of the missile. As used herein, unless otherwise noted, the term "set" means one or more (i.e., at least one) and the phrase "any solution" means any now known or later developed solution.

Figure 4:
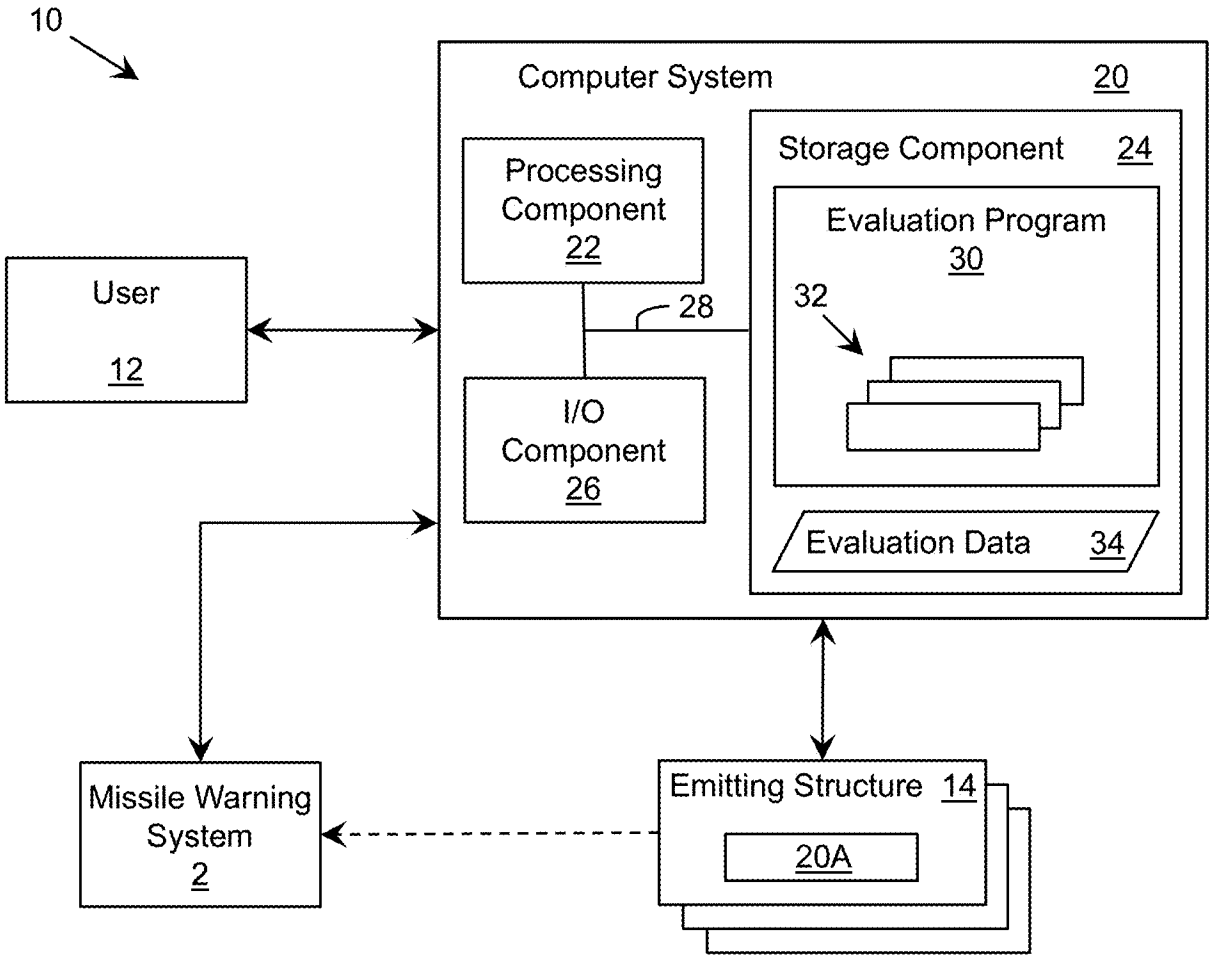
FIG. 4 shows an illustrative environment for evaluating a missile warning system according to an embodiment.

Turning to the drawings, FIG. 4 shows an illustrative environment 10 for evaluating a missile warning system 2 according to an embodiment. To this extent, the environment 10 includes a computer system 20 that can perform a process described herein in order to evaluate the missile warning system 2. In particular, the computer system 20 is shown including an evaluation program 30, which makes the computer system 20 operable to evaluate the missile warning system by performing a process described herein.

The computer system 20 is shown including a processing component 22 (e.g., one or more processors), a storage component 24 (e.g., a storage hierarchy), an input/output (I/O) component 26 (e.g., one or more I/O interfaces and/or devices), and a communications pathway 28. In general, the processing component 22 executes program code, such as the evaluation program 30, which is at least partially fixed in the storage component 24. While executing program code, the processing component 22 can process data, which can result in reading and/or writing transformed data from/to the storage component 24 and/or the I/O component 26 for further processing. The pathway 28 provides a communications link between each of the components in the computer system 20. The I/O component 26 can comprise one or more human I/O devices, which enable a human user 12 to interact with the computer system 20 and/or one or more communications devices to enable a system user 12 and/or the missile warning system 2 to communicate with the computer system 20 using any type of communications link. To this extent, the evaluation program 30 can manage a set of interfaces (e.g., graphical user interface(s), application program interface, and/or the like) that enable human and/or system users 12 to interact with the evaluation program 30. Furthermore, the evaluation program 30 can manage (e.g., store, retrieve, create, manipulate, organize, present, etc.) the data, such as evaluation data 34, using any solution.

In any event, the computer system 20 can comprise one or more general purpose computing articles of manufacture (e.g., computing devices) capable of executing program code, such as the evaluation program 30, installed thereon. As used herein, it is understood that "program code" means any collection of instructions, in any language, code or notation, that cause a computing device having an information processing capability to perform a particular action either directly or after any combination of the following: (a) conversion to another language, code or notation; (b) reproduction in a different material form; and/or (c) decompression. To this extent, the evaluation program 30 can be embodied as any combination of system software and/or application software.

Furthermore, the evaluation program 30 can be implemented using a set of modules 32. In this case, a module 32 can enable the computer system 20 to perform a set of tasks used by the evaluation program 30, and can be separately developed and/or implemented apart from other portions of the evaluation program 30. As used herein, the term "component" means any configuration of hardware, with or without software, which implements the functionality described in conjunction therewith using any solution, while the term "module" means program code that enables a computer system 20 to implement the actions described in conjunction therewith using any solution. When fixed in a storage component 24 of a computer system 20 that includes a processing component 22, a module is a substantial portion of a component that implements the actions. Regardless, it is understood that two or more components, modules, and/or systems may share some/all of their respective hardware and/or software. Furthermore, it is understood that some of the functionality discussed herein may not be implemented or additional functionality may be included as part of the computer system 20.

When the computer system 20 comprises multiple computing devices, each computing device can have only a portion of the evaluation program 30 fixed thereon (e.g., one or more modules 32). However, it is understood that the computer system 20 and the evaluation program 30 are only representative of various possible equivalent computer systems that may perform a process described herein. To this extent, in other embodiments, the functionality provided by the computer system 20 and the evaluation program 30 can be at least partially implemented by one or more computing devices that include any combination of general and/or specific purpose hardware with or without program code. In each embodiment, the hardware and program code, if included, can be created using standard engineering and programming techniques, respectively.

Regardless, when the computer system 20 includes multiple computing devices, the computing devices can communicate over any type of communications link. Furthermore, while performing a process described herein, the computer system 20 can communicate with one or more other computer systems using any type of communications link. In either case, the communications link can comprise any combination of various types of optical fiber, wired, and/or wireless links; comprise any combination of one or more types of networks; and/or utilize any combination of various types of transmission techniques and protocols.

As discussed herein, the evaluation program 30 enables the computer system 20 to evaluate the missile warning system 2. To this extent, as part of the evaluation, the computer system 20 can use a set of emitting structures 14 to simulate an irradiance signature of a missile plume. Each emitting structure 14 can be configured to communicate with the computer system 20 and/or other emitting structure(s) 14 using any communications solution. To this extent, each emitting structure 14 itself can include a computer system 20A, which is capable of sending, receiving, and processing data, and can be configured similar to the computer system 20. In an embodiment, each emitting structure 14 is configured to communicate with the computer system 20 and/or other emitting structures 14 using a wireless communications solution. To this extent, each emitting structure 14 can include a transceiver I/O device (e.g., as part of an I/O component 26 of the computer system 20A), which is capable of transmitting and receiving wireless signals.

A plurality of emitting structures 14 can form a communications network, which also can include the computer system 20, in which any of the emitting structures 14 can communicate with one or more of the emitting structures 14 and/or the computer system 20. The communications between two emitting structures 14 can be performed directly and/or via another computer system, such as an intermediate emitting structure 14, the computer system 20, and/or the like. In an embodiment, the emitting structures 14 use an optical communications solution.

Figure 5A:
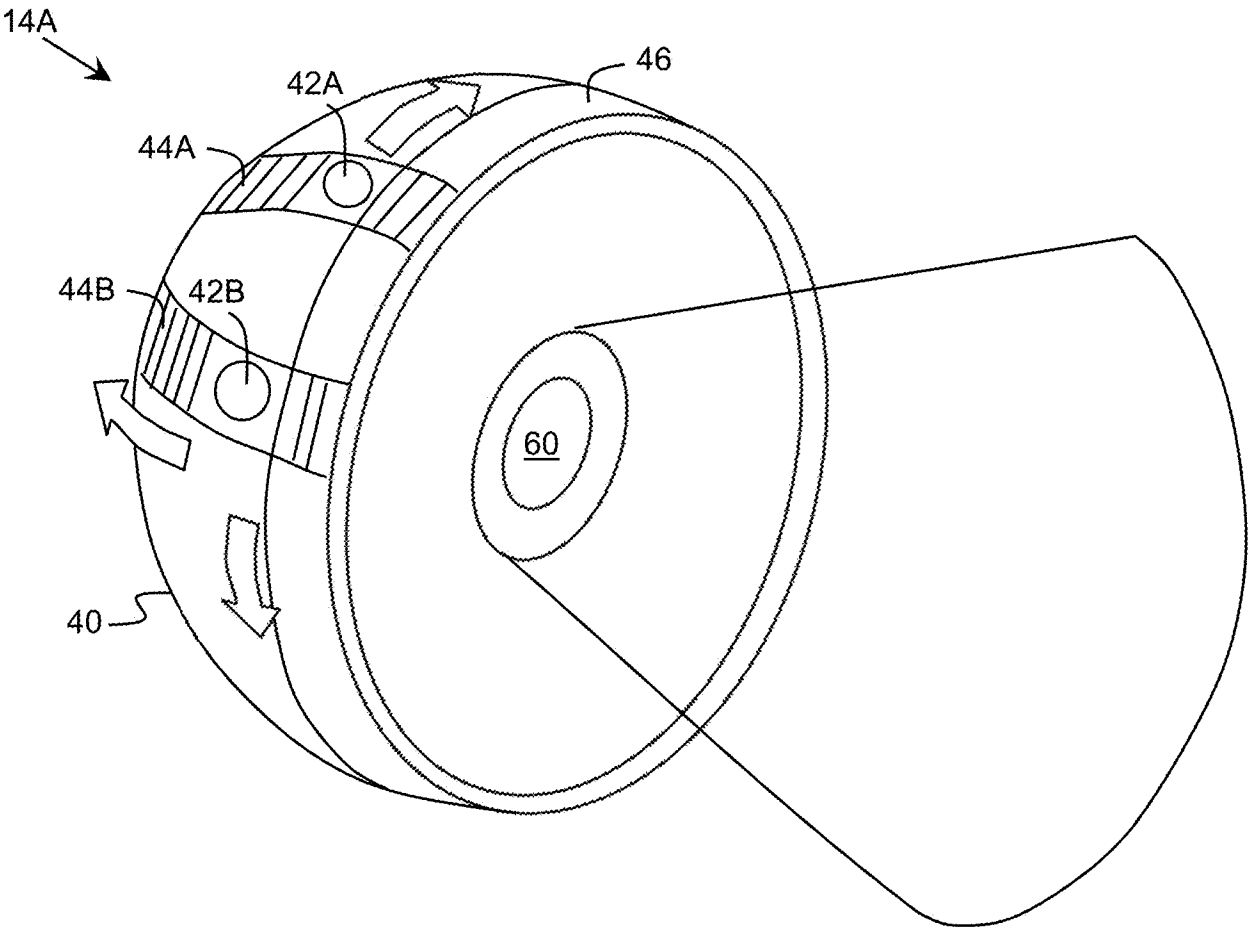
FIGS. 5A and 5B show schematic assemblies of illustrative emitting structures according to embodiments.
Figure 5B:
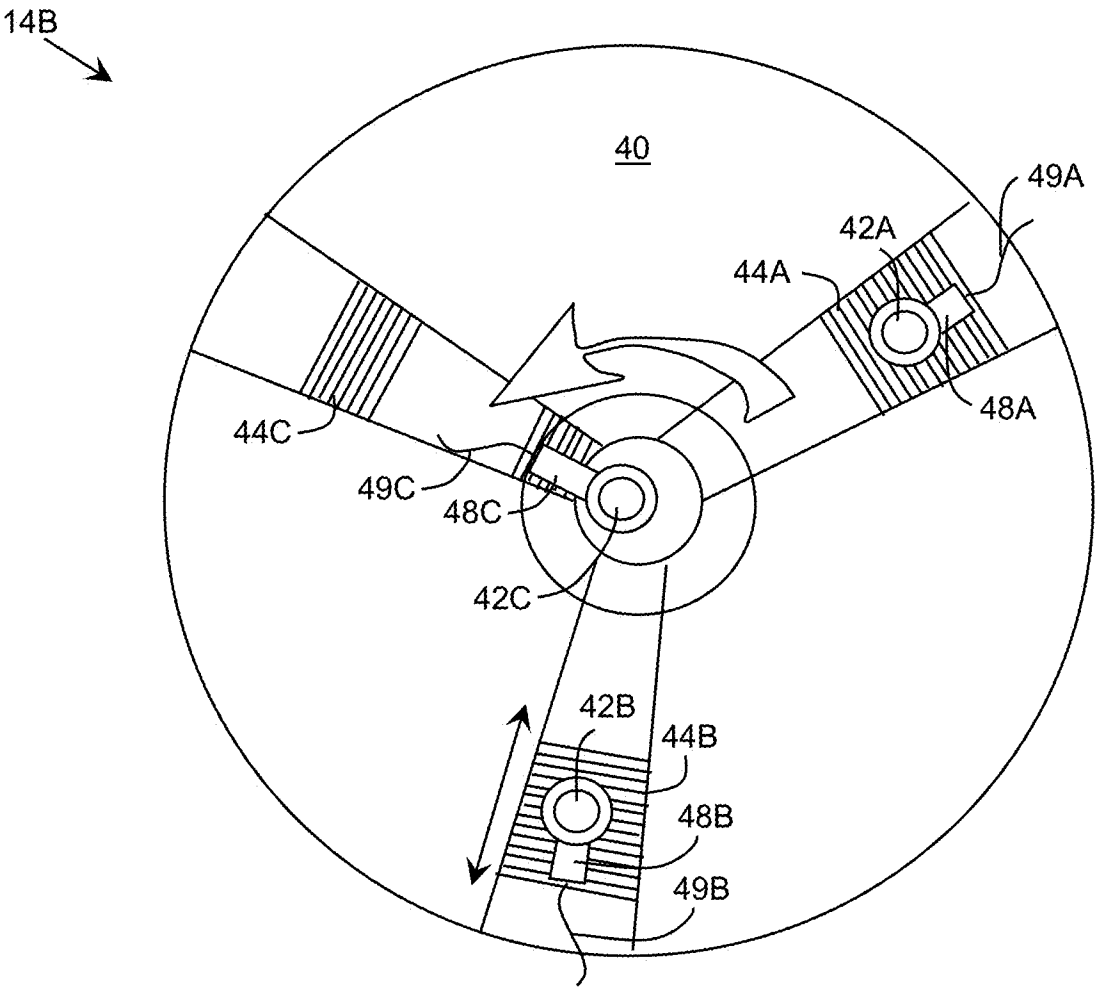

Regardless, each emitting structure 14 can include a plurality of configurable radiation sources to simulate any of a plurality of possible irradiance signatures of a missile plume. To this extent, FIGS. 5A and 5B show perspective and top view schematic assemblies of illustrative emitting structures 14A, 14B, respectively, according to embodiments. Each of the emitting structures 14A, 14B include a spherical shell 40 on which a plurality of radiation sources 42A-42C can be located. Each radiation source 42A-42C is configured to generate radiation that is directed to an interior of the spherical shell 40.

The radiation sources 42A-42C can be positioned in various locations along a three dimensional boundary of the spherical shell 40. For example, in FIG. 5A, each radiation source 42A, 42B is shown affixed to a corresponding altitude sliding rail 44A, 44B, respectively. A computer system 20A (FIG. 4) can independently operate the altitude sliding rails 44A, 44B to move and locate the corresponding radiation sources 42A, 42B to target positions at any point along an altitudinal direction of the spherical shell 40. Alternatively, as shown in FIG. 5B, each radiation source 42A-42C can be affixed to a corresponding movement mechanism 48A-48C, respectively, which in turn is movably attached to a corresponding altitude sliding rail 44A-44C, respectively. In this case, the computer system 20A can independently operate each movement mechanism 48A-48C to move and locate the corresponding radiation sources 42A-42C to target positions at any point along an altitudinal direction of the spherical shell 40. In an embodiment, each movement mechanism 48A-48C can comprise an electric motor with an attached gear wheel. The gear wheel can be engaged with a toothed structure of the altitude sliding rail 44A-44C to enable the movement of the radiation source 42A-42C along the altitudinal direction. Furthermore, the spherical shell 40 can include an azimuthal sliding rail 46 (as shown in FIG. 5A), which the computer system 20A can operate to locate the radiation sources 42A-42C in any of various locations along an azimuthal direction of the spherical shell 40. In an embodiment, each of the radiation sources 42A-42C can be positioned at any point of the spherical shell 40 with respect to a center point of the spherical shell 40 using the altitude sliding rails 44A-44C (and/or movement mechanisms 48A-48C) and the azimuthal sliding rail 46.

As illustrated, each movement mechanism 48A-48C can include a corresponding wire 49A-49C, each of which can be connected to an electrical source. In this case, the electrical source also can provide power to the corresponding radiation source 42A-42C. Alternatively, the movement mechanisms 48A-48C and the radiation sources 42A-42C can include their own power source, e.g., a battery. When the wires 49A-49C are used, the wires 49A-49C also can provide a wired communications connection between the computer system 20A and the movement mechanisms 48A-48C and/or the radiation sources 42A-42C. Alternatively, the movement mechanisms 48A-48C and/or the radiation sources 42A-42C can communicate with the computer system 20A using a wireless solution.

In an embodiment, the radiation sources 42A-42C, altitude sliding rails 44A-44C, and the azimuthal sliding rail 46 are mounted to an interior of the spherical shell 40. Alternatively, the radiation sources 42A-42C, altitude sliding rails 44A-44C, and the azimuthal sliding rail 46 can be mounted to an exterior of the spherical shell 40. In the latter case, the spherical shell can be formed of a material transparent to ultraviolet, visible, and/or infrared radiation. In an embodiment, the spherical shell 40 is formed of a transparent material, such as fused silica. When the radiation sources 42A-42C are mounted to the interior of the spherical shell 40, an interior of the spherical shell 40 can be formed of a substantially non-reflective material. In general, a size of the spherical shell 40 can be selected based on an environment in which the emitting structures 14A, 14B are to be used, a size of a detector 60, which can be placed therein, one or more attributes of the radiation sources 42A-42C, a desired simulation, and/or the like. For example, embodiments of the spherical shell 40 can have a diameter as small as a few centimeters (e.g., 2-6 centimeters) up to approximately a half a meter. For some simulations, a miniature simulation system may be required. In this case, the diameter of the spherical shell 40 can be a fraction of one centimeter.

Regardless, each radiation source 42A-42C can be configured to emit radiation in a direction substantially normal to its location on the spherical shell 40 regardless of its location on the spherical shell 40. In an embodiment, each radiation source 42A-42C includes a preconfigured set of light emitting devices. The light emitting devices for each radiation source 42A-42C can include any combination of zero or more of each of: an ultraviolet radiation emitting device, an infrared radiation emitting device, or a visible radiation emitting device. In an embodiment, each of the radiation emitting devices is a solid state emitting device. For example, the radiation emitting devices can include ultraviolet, infrared, and/or visible light emitting diodes.

Figure 6B:
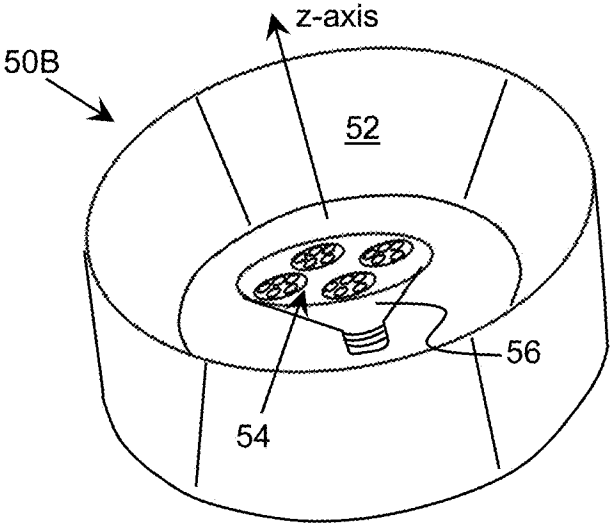
FIGS. 6A-6C show details of illustrative radiation sources according to embodiments.
Figure 6A:
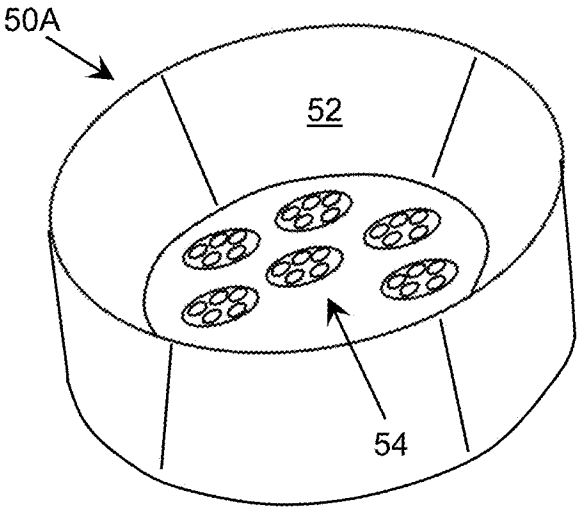
Figure 6C:
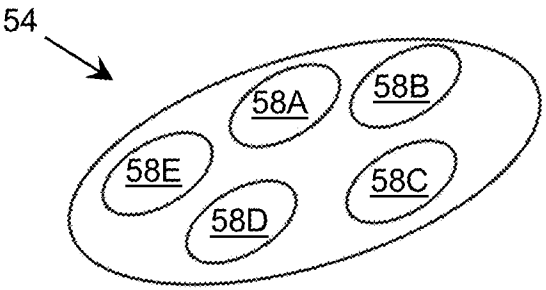

FIGS. 6A-6C show details of illustrative radiation sources 50A, 50B according to embodiments. Each radiation source 50A, 50B can include a reflective enclosure 52, which includes a set of emitting device arrays 54 therein. In radiation source 50A, the emitting device arrays 54 are fixed on a bottom surface of the enclosure 52. In radiation source 50B, the emitting device arrays 54 are fixed on a surface that is moveable relative to the reflective enclosure 52 along the z-axis. To this extent, the radiation source 50B includes a movement mechanism 56, which the computer system 20A (FIG. 4) can operate to move the emitting device arrays 54 to a target position along the z-axis using any solution. In an embodiment, the movement mechanism 56 comprises a threaded mechanism that the computer system 20A can turn to move the emitting device arrays 54 up or down along the z-axis. By enabling movement of the emitting device arrays 54 up and down the z-axis, a perceived radiation pattern generated by the radiation source 50B can be altered. For example, the radiation emitted by the emitting device array 54 can be focused and defocused, which can alter a size of the perceived radiation pattern generated by the radiation source 50B. In another embodiment, a lens can be located over a radiation source 50A, 50B and/or over a detector 60, to adjust one or more aspects of the radiation emitted by the radiation sources 50A, 50B.

FIG. 6C shows further details of an illustrative emitting device array 54. The emitting device array 54 can include a set of emitting devices 58A-58E, such as light emitting diodes. The emitting devices 58A-58E can emit radiation having a plurality of different peak wavelengths. In an embodiment, the set of emitting devices 58A-58E includes at least one emitting device that emits ultraviolet radiation and at least one emitting device that emits infrared radiation. In a further embodiment, the set of emitting devices 58A-58E also includes at least one emitting device that emits visible radiation.

In an embodiment, the set of emitting devices 58A-58E includes at least four light emitting device dies. In particular, the set of emitting devices 58A-58E can include three ultraviolet light emitting device dies, each of which emits ultraviolet light having a peak wavelength centered around unique wavelengths of approximately 0.27, 0.28, and 0.29 microns. These ultraviolet radiation wavelengths cover an ultraviolet window between 0.27-0.29 microns, which is available for missile detection and corresponds to the chemiluminescence of hydroxyl. Additionally, the set of emitting devices can include at least one infrared light emitting device, which emits infrared radiation having a peak wavelength centered around a wavelength of approximately 4.5 microns, which corresponds to gas thermal emissions of carbon monoxide and carbon dioxide.

In a more particular embodiment, the set of emitting devices 58A-58E also includes at least three additional infrared light emitting devices, each of which emits infrared radiation having a peak wavelength centered around unique wavelengths of approximately 2.45, 3.0, and 4.2 microns. The four infrared wavelengths include the wavelengths that can be radiated and transmitted by a missile plume in the infrared spectrum. Furthermore, the set of emitting devices 58A-58E also can include one or more visible light emitting devices, such as a set of at least three visible light emitting devices, each of which emits visible radiation having a peak wavelength centered around unique wavelengths of approximately 0.59, 0.68, and 0.79 microns, which correspond to gas thermal emissions of sodium and potassium compounds. However, it is understood that an emitting device array 54 can include any combination of ultraviolet, infrared, and/or visible emitting devices, including two or more emitting devices, which emit radiation having substantially the same wavelengths.

Returning to FIGS. 6A and 6B, the set of emitting device arrays 54 in a radiation source 50A, 50B can be assembled in a predefined pattern. The pattern can be configured to substantially match one or more attributes of a radiation pattern of a plume of a target missile being simulated. The pattern also can be adjusted according to a target view angle being simulated. For example, the pattern can attempt to substantially reproduce an angular distribution of the radiated intensity as viewed from a particular view angle. In an embodiment, several different radiation sources 50A, 50B can be available for selection for simulating a target missile, each with a unique radiation pattern. Illustrative configurations for radiation sources 50A, 50B include: a pattern to match a frontal view of the target missile; a pattern to match a side view of the target missile; and/or the like. Other patterns can match various other view angles. Furthermore, other patterns can be derived by combining the frontal and side views with different sizes and shapes of the missile plume, which can change due to speed and/or altitude of the target missile. For example, the radiation source 50B can be used to generate perceived radiation patterns of varying sizes as discussed herein.

The emitting device arrays 54 and/or the set of emitting devices 58A-58E in each emitting device array 54 can be operated as a group and/or independently by the computer system 20A (FIG. 4). In an embodiment, the computer system 20A can independently adjust a relative intensity of the radiation emitted by an emitting device array 54 in a radiation source 50A, 50B and/or an emitting device 58A-58E in a set of emitting devices 58A-58E to simulate one or more changes to a plume signature, e.g., due to atmospheric conditions, or the like. Similarly, the computer system 20A can adjust an intensity of the radiation emitted by a radiation source 50A, 50B to simulate, for example, varying distances from the missile.

Returning to FIGS. 4 and 5A, as discussed herein, the emitting structure 14 can be utilized to evaluate one or more aspects of a missile warning system 2. For example, a detector 60 of the missile warning system 2 can be positioned at a center of the spherical shell 40. By moving and operating the radiation sources 42A-42B, the computer system 20A can simulate spatial movement of a target missile with respect to the detector 60. The missile warning system 2 can be configured to infer a radial distance between the detector 60 and a tracked missile based on an intensity of the radiation detected at the detector 60. However, the precision of such an estimate can be very low.

Figure 7:
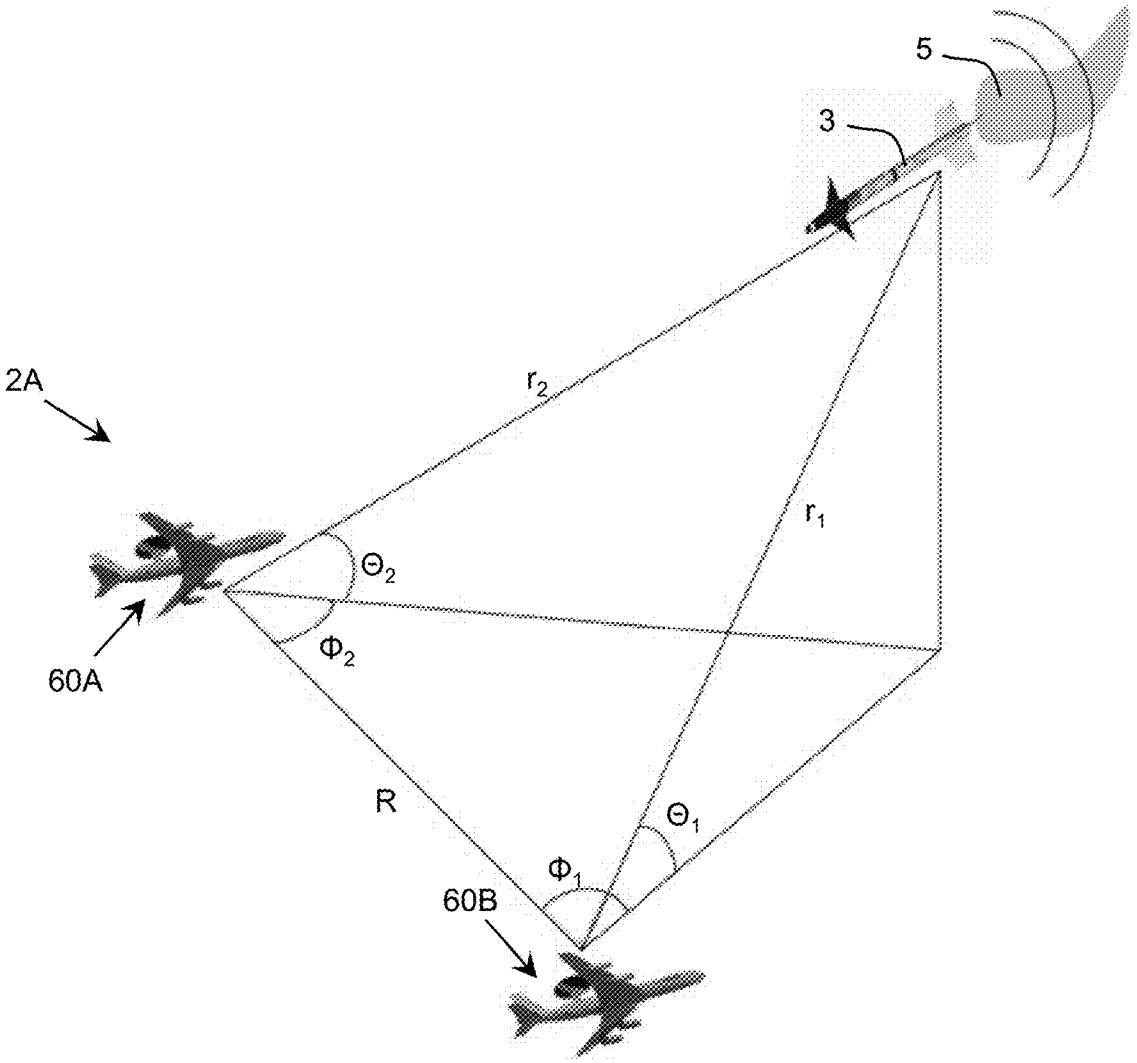
FIG. 7 shows an illustrative configuration of a missile warning system, in which triangulation is used to track a missile according to an embodiment.

FIG. 7 shows an illustrative configuration of a missile warning system 2A, in which triangulation is used to track a missile 3 according to an embodiment. In particular, the missile warning system 2A can include a pair of airborne detectors 60A, 60B (e.g., located on an airplane as shown), each of which is configured to detect and track the missile 3 via an irradiance signature of the missile plume 5. In this configuration, a location of the missile 3 can be determined using known positions of the detectors 60A, 60B and triangulation. In particular, the two detectors 60A, 60B are separated from one another by a known distance R. The azimuthal angles $\phi_1$, $\phi_2$ and altitude angles $\Theta_1$, $\Theta_2$ corresponding to the relative positions of the detectors 60A, 60B and missile 3 can be determined. Using this information, the radial distances $r_1$, $r_2$ can be calculated using a system of trigonometric relations such as: $r_1 \sin \Theta_1 = r_2 \sin \Theta_2$, and $r_1 \cos \Theta_1 \cos \phi_1 + r_2 \cos \Theta_2 \cos \phi_2 = R$.

Figure 8A:
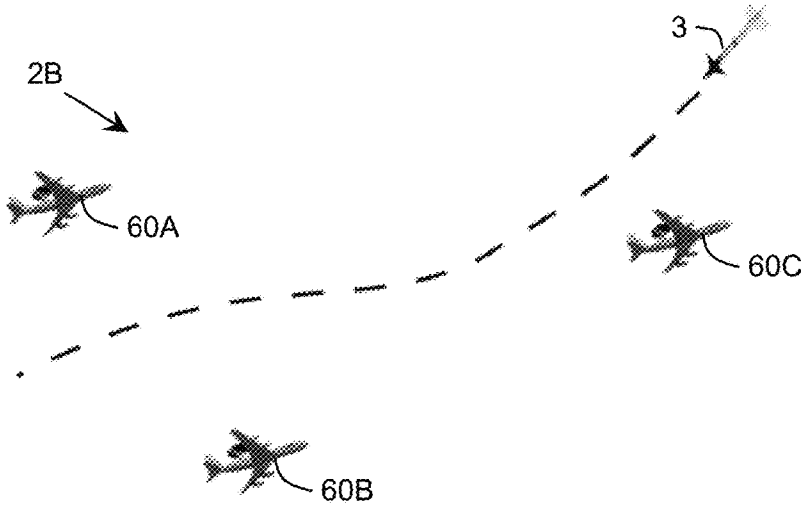
FIGS. 8A, 8B show an illustrative missile warning system and corresponding simulation environment, respectively, according to an embodiment.
Figure 8B:
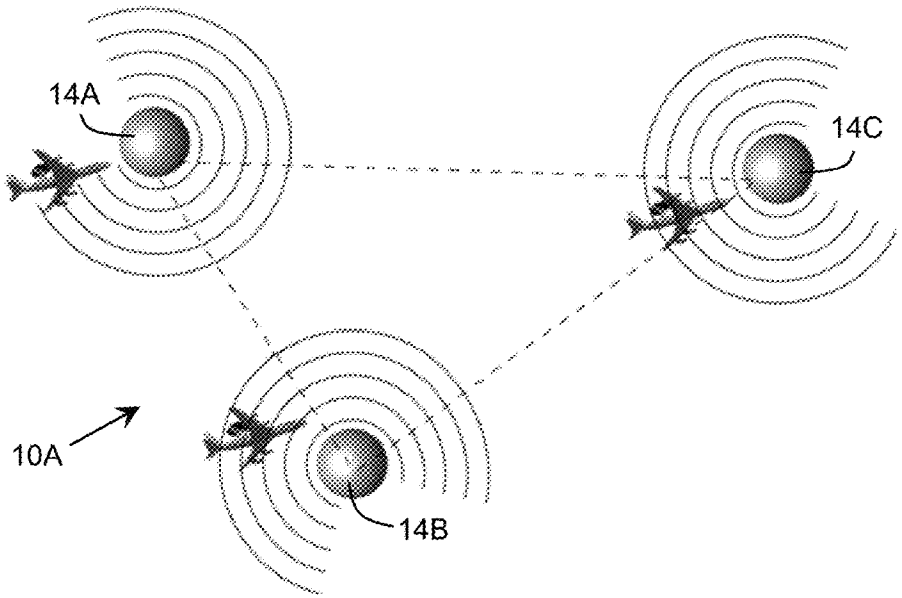

In an embodiment, the environment 10 (FIG. 4) can simulate an ability for a missile warning system 2A to track a missile 3 using triangulation. In this case, the environment 10 can include a plurality of emitting structures 14 (FIG. 4), each including a unique detector corresponding to one of the detectors 60A, 60B of the missile warning system 2A being simulated. For example, FIGS. 8A, 8B show an illustrative missile warning system 2B and corresponding simulation environment 10A, respectively, according to an embodiment. As illustrated in FIG. 8A, the missile warning system 2B can include three detectors 60A-60C. A simulation of an ability of the detectors 60A-60C to successfully detect and track a missile 3 having the flight trajectory shown may be desired. The flight trajectory can be a sufficiently large distance that the tracking requires a handoff from one detector, such as detector 60C, to another detector, such as detector 60A.

Referring to FIGS. 4, 8A, and 8B, in order to implement a simulation, the environment 10A can include three emitting structures 14A-14C, each of which can include a detector, which corresponds to one of the detectors 60A-60C of the missile warning system 2B. As described herein, the emitting structures 14A-14C can communicate with each other over a communications network, e.g., using a wireless communications solution. During a simulation, communications between the emitting structures 14A-14C can be used to, for example, synchronize the signals between all of the emitting structures 14A-14C so that each of the emitting structures 14A-14C can generate radiation having attributes and timing that accurately simulates the missile 3 and its flight path as it would be concurrently viewed by the detectors 60A-60C. While not shown in FIG. 8B, the computer system 20 can be included in the environment 10A and manage the simulation as described herein. Furthermore, as part of the missile warning system 2B, the detectors 60A-60C can communicate with one another and/or a central system, e.g., to perform a handoff of the tracking functions, provide a location information, and/or the like, which can be implemented independent of the simulation equipment (e.g., the emitting structures 14A-14C, the computer system 20, and/or the like). In an embodiment, the emitting structures 14A-14C communicate with one another and the computer system 20 using an optical communications solution, e.g., to achieve complete radio silence so as not to allow the communications to be readily detected by an unauthorized party. To this extent, the environment 10A can include a plurality of communicating towers with line of sight long range communication links and non-line of sight short range distributed networks. A detector 60A-60C and a corresponding emitting structure 14A-14C can be located on each tower. The simulation can approximate an actual spacing for the detectors 60A-60C, e.g., to evaluate the communications of the detectors 60A-60C. In this case, the towers can be located from approximately a few tens of miles up to approximately one hundred miles from one another. Furthermore, in an embodiment, the simulation can be performed in situ, with the detectors 60A-60C configured as they will be deployed (e.g., on an aircraft), but with the emitting structures 14A-14C placed thereon. In still another embodiment, the distance between the detectors 60A-60C can be simulated. In this case, the detectors 60A-60C and corresponding emitting structures 14A-14C can be located relatively close to one another, e.g., within a few feet.

To commence a simulation, the computer system 20 can obtain evaluation data 34 corresponding to a desired simulation using any solution. For example, the simulation can be stored in the evaluation data 34, and can be executed any number of times by the evaluation environment 10A. Alternatively, the computer system 20 can receive the simulation from a user 12, and can subsequently store the simulation in the evaluation data 34. Furthermore, it is understood that various combinations of different simulation configurations can be selected for a particular simulation, e.g., to evaluate different weather conditions, times of day, missiles, detector configurations, and/or the like. The computer system 20 can enable a user 12 to configure the simulation using any solution (e.g., by providing values for one or more attributes), and can construct the simulation, store the settings for the simulation, store data corresponding to the simulation, and data corresponding to results of the simulation as evaluation data 34 using any solution.

Regardless, the simulation can define various attributes of the simulation. For example, the simulation can define a type of missile 3 being simulated, a number of detectors 60A-60C to be included, the locations of the detectors 60A-60C in a three-dimensional space, and/or the like. In an embodiment, the computer system 20 can store various plume attributes of a plume corresponding to the type of missile 3 in the evaluation data 34, which the computer system 20 can access and utilize during the simulation. For example, the attributes can include a defined irradiance signature for the plume, changes to the plume based on the missile speed, altitude, relative orientation, and/or the like.

Additionally, the simulation can define a set of missile operating conditions for the missile 3. The missile operating conditions can include an initial position of the missile 3 at the start of the simulation in the three-dimensional space, as well as a trajectory of the missile 3 for the simulation. The trajectory can include the velocity of the missile 3 for the simulation, as well as any changes in speed and/or direction and the corresponding timing/locations for the changes, which may occur during the simulation. Using the initial position information for the missile 3, the computer system 20 can calculate the spherical coordinate values ($\phi$, $\Theta$, r) of the missile 3 with respect to each of the detectors 60A-60C at the start of the simulation. It is understood however, that some or all of the detectors 60A-60C may not be able to perceive the missile 3 at the start of the simulation (e.g., due to a distance, r, being too great).

The missile operating conditions also can include one or more atmospheric conditions for the simulation. For example, the simulation can define a set of air transmission conditions along a line of sight from the missile 3 to each of the detectors 60A-60C in the simulation environment 10A, which can attenuate the plume attributes along the simulated distance. Additionally, the atmospheric conditions can include spurious conditions, such as background noise due to sun radiation, light scattering off of regions containing a high concentration of ozone or humidity, and/or the like. For each detector 60A-60C, the atmospheric conditions can change as the missile 3 is simulated as moving from one location to another. To this extent, the simulation can define a plurality of atmospheric conditions, each of which corresponds to a unique combination of a missile 3 location (or time in the simulation) and one of the detectors 60A-60C.

To commence the simulation, the computer system 20 can use the location of the missile 3, the detectors 60A-60C, the plume attributes, and the atmospheric conditions to calculate, for each of the detectors 60A-60C, a plume irradiance appearance for the missile 3 that will be present at the location of the detector 60A-60C. For example, the computer system 20 can account for the type of the missile 3, its speed and altitude at the start of the simulation, the orientation of the missile 3 with respect to each detector 60A-60C, and/or the like, to determine an initial set of plume irradiance attributes. Furthermore, the computer system 20 can adjust an intensity of the plume irradiance attributes based on the air transmission conditions and the distance between each detector 60A-60C and the missile 3 to calculate the plume irradiance appearance at each of the detectors 60A-60C. In an embodiment, the computer system 20 can store the plume irradiance attributes for the simulation as time dependent waveform data.

The computer system 20 can provide the calculated plume irradiance appearance and the angular coordinate values ($\phi$, $\Theta$) for processing by the computer system 20A for each of the emitting structures 14A-14C in the simulation environment 10A. The computer system 20A can select a corresponding radiation source 42A-42C (FIG. 5B) to best simulate the plume irradiance appearance and locate the selected radiation source 42A-42C to an appropriate starting point based on the angular coordinate values. The computer system 20A for each emitting structure 14A-14C also can convert the plume irradiance appearance into a corresponding input voltage pattern (signal), which the computer system 20A can apply to the selected radiation source 42A-42C to generate a radiation pattern that simulates the plume irradiance appearance.

The simulation can proceed for a target amount of simulation time, simulated distance traveled by the missile 3, until an error in the missile warning system 2B being evaluated is detected, until a request to stop is received from a user 12, and/or the like. During the simulation, the computer system 20 can update is calculations of the plume irradiance appearance at each of the detectors 60A-60C based on changes to the missile location, missile orientation, the missile velocity, the air transmission conditions, and/or the like. The computer system 20 can provide the updated plume irradiance appearance for processing by the computer system 20A of each of the emitting structures 14A-14C, which in turn can adjust a location of the selected radiation source 42A-42C, recalculate and adjust an input voltage pattern for the selected radiation source 42A-42C, and/or the like. For simulating a large distance, the computer system 20 can send instructions to one emitting structure 14A-14C to no longer generate a plume irradiance since the corresponding detector 60A-60C is too far away from the simulated missile 3 location. Similarly, the computer system 20 can commence sending instructions to another emitting structure after the start of the simulation once the simulated missile 3 location is sufficiently close to the corresponding detector 60A-60C.

During the simulation, the detectors 60A-60C can be evaluated to determine whether they are accurately tracking the simulated missile 3. For example the missile warning system 2B can continually use detection data for two or more detectors 60A-60C to calculate a position of the simulated missile 3 using triangulation, which the computer system 20 (or another computer system) can compare with the current simulated position of the missile 3 for accuracy. Furthermore, in response to a distance between a first detector 60A-60C and the missile 3 approaching a limit of the detector 60A-60C tracking range and the missile 3 being within a tracking range of a second detector 60A-60C, the missile coordinates can be communicated from the first detector to the second detector and the second detector can commence tracking the missile 3. The computer system 20 can monitor the handoff between the detectors 60A-60C and evaluate whether it was done properly using any solution. In any event, at the completion of the simulation, the computer system 20 can store a result of the simulation as evaluation data 34 for the missile warning system 2B, provide the evaluation data 34 for use by a user 12, and/or the like.

Figure 1:
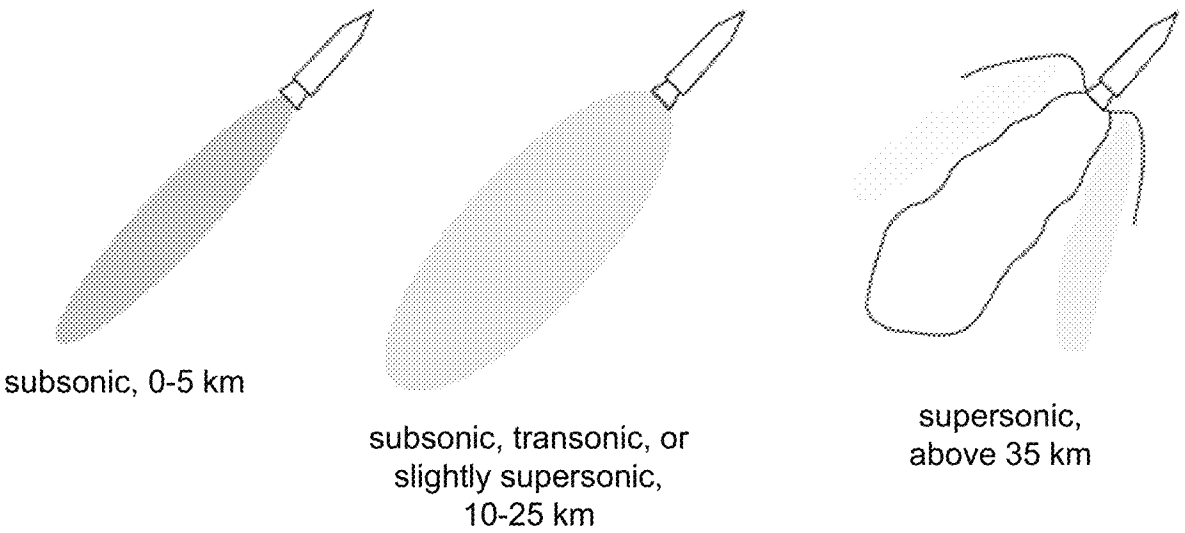
FIG. 1 Prior Art
FIG. 1 shows a representation of the plume characteristics' dependence on a velocity of the rocket as shown in the prior art.
Figure 2:
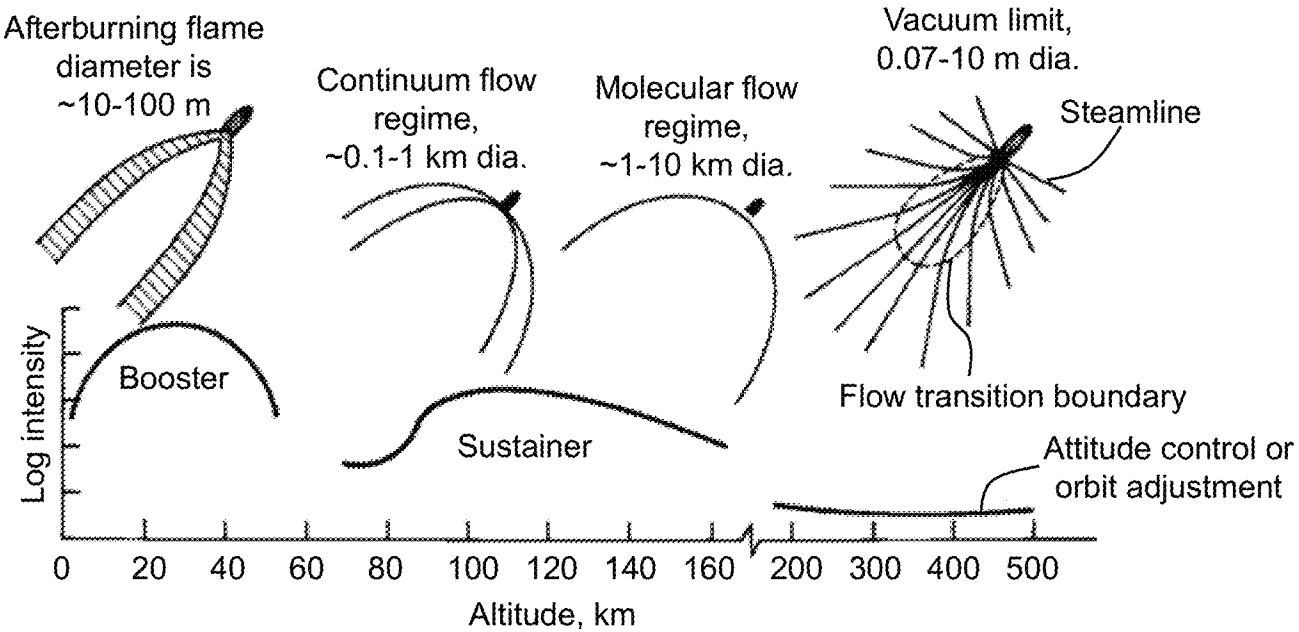
FIG. 2 Prior Art
FIG. 2 shows a schematic of the plume diameter as a function of altitude as shown in the prior art.
Figure 3:
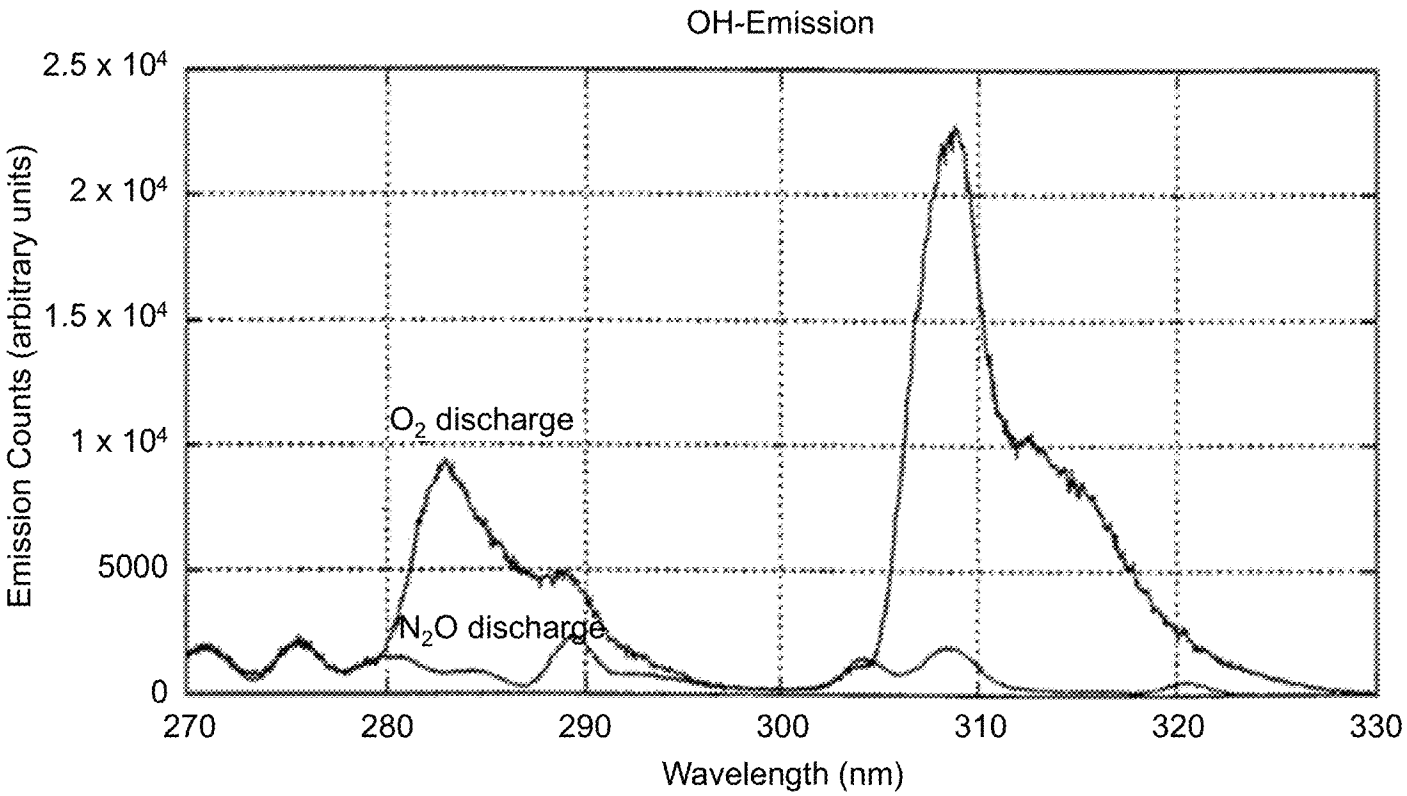
FIG. 3 Prior Art
FIG. 3 shows a representative hydroxyl emission spectrum as shown in the prior art.

While shown and described herein as a method and system for simulating an irradiance signature of a missile plume, it is understood that aspects of the invention further provide various alternative embodiments. For example, in one embodiment, the invention provides a computer program fixed in at least one computer-readable medium, which when executed, enables a computer system to simulate an irradiance signature of a missile plume. To this extent, the computer-readable medium includes program code, such as evaluation program 30 (FIG. 1), which enables a computer system to implement some or all of a process described herein. It is understood that the term "computer-readable medium" comprises one or more of any type of tangible medium of expression, now known or later developed, from which a copy of the program code can be perceived, reproduced, or otherwise communicated by a computing device. For example, the computer-readable medium can comprise: one or more portable storage articles of manufacture; one or more memory/storage components of a computing device; paper; and/or the like.

In another embodiment, the invention provides a method of providing a copy of program code, such as evaluation program 30 (FIG. 1), which enables a computer system to implement some or all of a process described herein. In this case, a computer system can process a copy of the program code to generate and transmit, for reception at a second, distinct location, a set of data signals that has one or more of its characteristics set and/or changed in such a manner as to encode a copy of the program code in the set of data signals. Similarly, an embodiment of the invention provides a method of acquiring a copy of the program code, which includes a computer system receiving the set of data signals described herein, and translating the set of data signals into a copy of the computer program fixed in at least one computer-readable medium. In either case, the set of data signals can be transmitted/received using any type of communications link.

In still another embodiment, the invention provides a method of generating a system for simulating an irradiance signature of a missile plume. In this case, a computer system, such as computer system 20 (FIG. 1), can be obtained (e.g., created, maintained, made available, etc.) and one or more components for performing a process described herein can be obtained (e.g., created, purchased, used, modified, etc.) and deployed to the computer system. To this extent, the deployment can comprise one or more of: (1) installing program code on a computing device; (2) adding one or more computing and/or I/O devices to the computer system; (3) incorporating and/or modifying the computer system to enable it to perform a process described herein; and/or the like.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

What is claimed is:

1. A system comprising:

an emitting structure including:

a plurality of radiation sources, each of the plurality of radiation sources including at least one ultraviolet radiation source and at least one infrared radiation source configured to generate a unique radiation pattern;

a spherical shell; and means for independently positioning each of the plurality of radiation sources along a three dimensional boundary of the spherical shell; and a computer system for simulating an irradiance signature of a missile using a first radiation source of the plurality of radiation sources and the means for independently positioning, wherein the simulating includes, for each of a plurality of simulation times:

determining a relative location of the simulated missile with respect to a target location;

determining a plume irradiance appearance at the target location based on the relative location, a missile type for the missile, and a set of missile operating conditions for the missile;

selecting the first radiation source based on the first pattern matching the plume irradiance appearance better than the radiation pattern generated by any of the other of the plurality of radiation sources;

locating the first radiation source to a location on the spherical shell corresponding to the relative location; and generating a radiation pattern simulating the plume irradiance appearance using the first radiation source.

2. The system of claim 1, wherein the first radiation source further includes a visible radiation source.

3. The system of claim 1, wherein the means for independently positioning includes a plurality of altitude sliding rails, wherein the computer system is configured to locate each of the plurality of radiation sources along an altitudinal direction of the spherical shell using a corresponding one of the plurality of altitude sliding rails.

4. The system of claim 1, wherein each of the plurality of radiation sources further includes:

a reflective enclosure surrounding the at least one ultraviolet radiation source and the at least one infrared radiation source; and means for moving the at least one ultraviolet radiation source and the at least one infrared radiation source with respect to the reflective enclosure.

5. The system of claim 1, wherein the at least one ultraviolet radiation source for at least one of the plurality of radiation sources is configured to:

emit ultraviolet radiation having a peak wavelength centered around approximately 0.27 microns;

emit ultraviolet radiation having a peak wavelength centered around approximately 0.28 microns; and emit ultraviolet radiation having a peak wavelength centered around approximately 0.29 microns.

6. The system of claim 1, wherein the at least one infrared radiation source for at least one of the plurality of radiation sources is configured to emit infrared radiation having a peak wavelength centered around approximately 4.5 microns.

7. The system of claim 6, wherein the at least one infrared radiation source for the at least one of the plurality of radiation sources is further configured to:

emit infrared radiation having a peak wavelength centered around approximately 2.45 microns;

emit infrared radiation having a peak wavelength centered around approximately 3.0 microns; and emit infrared radiation having a peak wavelength centered around approximately 4.2 microns.

8. The system of claim 1, further comprising a detector located at a center of the spherical shell, wherein the target location corresponds to a simulated location of the detector.

9. The system of claim 8, wherein the system includes a plurality of emitting structures, each with a corresponding detector, and wherein the simulating evaluates an ability of the detectors to track the missile.

10. A system comprising:

a plurality of emitting structures, each emitting structure including:

a first radiation source including at least one ultraviolet radiation source and at least one infrared radiation source; and means for positioning the first radiation source along a three dimensional sphere;

a plurality of detectors, each detector located at a center of the sphere of one of the plurality of emitting structures; and a computer system for simulating, for each of the plurality of detectors, an irradiance signature of a missile at the detector using the first radiation source and the means for positioning of the corresponding emitting structure, wherein the simulating includes, for each of the plurality of detectors and a plurality of simulation times:

determining a relative location of the simulated missile with respect to a simulated position of the detector;

determining a plume irradiance appearance at the detector based on the relative location, a missile type for the missile, and a set of missile operating conditions for the missile;

locating the first radiation source to a location on the sphere corresponding to the relative location; and generating a radiation pattern simulating the plume irradiance appearance using the first radiation source.

11. The system of claim 10, wherein the computer system uses a plurality of plume irradiance attributes stored as time dependent waveform data to simulate the irradiance signature of the missile.

12. The system of claim 10, wherein the simulating evaluates an ability of the detectors to track the missile using triangulation.

13. The system of claim 10, wherein the simulating evaluates an ability of one of the plurality of detectors to handoff tracking the missile to another one of the plurality of detectors.

14. The system of claim 10, wherein each of the plurality of emitting structures further includes means for communicating with at least one other emitting structure during the simulating.

15. A system comprising:

an emitting structure including:

a plurality of radiation sources, each radiation source including at least one ultraviolet radiation source and at least one infrared radiation source having a unique pattern; and means for positioning the plurality of radiation sources along a three dimensional boundary of a sphere; and a computer system for simulating an irradiance signature of a missile using one of the plurality of radiation sources and the means for positioning, wherein the simulating includes:

selecting one of the plurality of radiation sources based on the irradiance signature and the unique pattern for each of the plurality of radiation sources; and for each of a plurality of simulation times:

determining a relative location of the simulated missile with respect to a target location;

determining a plume irradiance appearance at the target location based on the relative location, a missile type for the missile, and a set of missile operating conditions for the missile;

locating the selected radiation source to a location on the sphere corresponding to the relative location; and generating a radiation pattern simulating the plume irradiance appearance using the selected radiation source.

16. The system of claim 15, further comprising a detector located at a center of the sphere, wherein the target location corresponds to a simulated location of the detector.

17. The system of claim 16, wherein the system includes a plurality of emitting structures, each with a corresponding detector, and wherein the simulating evaluates an ability of the detectors to track the missile using triangulation.

18. The system of claim 16, wherein the simulating evaluates an ability of one of the plurality of detectors to handoff tracking the missile to another one of the plurality of detectors.

19. The system of claim 16, wherein each of the plurality of emitting structures further includes means for communicating with at least one other emitting structure during the simulating.

20. The system of claim 16, wherein the means for independently positioning includes a plurality of altitude sliding rails, wherein the computer system is configured to locate each of the plurality of radiation sources along an altitudinal direction of the sphere using a corresponding one of the plurality of altitude sliding rails.

* * * * *